United States Patent [19]

Dörling et al.

[11] Patent Number: 4,478,606

[45] Date of Patent: Oct. 23, 1984

[54] SUBSTANTIALLY VERTICAL APPARATUS FOR COOLING PROCESS GASES ORIGINATING FROM A GASIFICATION PROCESS

[75] Inventors: Rolf Dörling; Ulrich Premel, both of Gummersbach, Fed. Rep. of Germany

[73] Assignee: L. & C. Steinmüller GmbH, Gummersbach, Fed. Rep. of Germany

[21] Appl. No.: 417,872

[22] Filed: Sep. 14, 1982

[30] Foreign Application Priority Data

Sep. 22, 1981 [DE] Fed. Rep. of Germany ..... 3137576

[51] Int. Cl.[3] ..... C10J 3/84; C10J 3/86

[52] U.S. Cl. ..... 48/77; 48/128; 55/269; 122/7 R

[58] Field of Search ..... 48/128, 210, 77; 55/269, 80; 122/7 R, 379, 396; 110/216

[56] References Cited

U.S. PATENT DOCUMENTS

| | | | |
|---|---|---|---|
| 4,018,267 | 4/1977 | Tomasicchio | 122/379 |
| 4,248,604 | 2/1981 | Woldy et al. | 55/80 |
| 4,251,228 | 2/1981 | Muenger et al. | 55/80 |
| 4,270,493 | 6/1981 | Blaskowski | 48/77 |
| 4,309,196 | 1/1982 | Vollhardt | 55/269 |
| 4,324,563 | 4/1982 | Jones et al. | 48/128 |
| 4,395,268 | 7/1983 | Zabelka | 55/269 |

*Primary Examiner*—S. Leon Bashore

*Assistant Examiner*—K. M. Hastings

*Attorney, Agent, or Firm*—Becker & Becker, Inc.

[57] ABSTRACT

A substantially vertical apparatus for cooling process gases originating from a gasification process, along with simultaneous separation of solid matter contained in the process gases. The apparatus is a cylindrical container including several cylindrical container parts. A gas inlet is provided in the lower region of the container shell or mantle and substantially tangential thereto. The gas inlet opens into a cyclone. Cooling surfaces are provided above the cyclone, with those directly above the cyclone being embodied as platen heat transfer surfaces, and those further above being embodied as cylindrical heat transfer surfaces. The cylindrical heat transfer surfaces are suspended in the container via support elements in the manner of an immersion heater. The support elements, in conjunction with a tube and a regulating device arranged at the process gas outlet, regulate the volume or quantity of the process gases flowing or circulating around the upper cylindrical heat transfer surface. Aside from the platen heat transfer surface and the cylindrical heat transfer surfaces, container wall cooling surfaces are provided as vertical heat transfer surfaces having a tube-crosspiece-tube construction, the container wall cooling surfaces being centered with respect to the outer wall of the container via a packing mass. Beating or striking devices for cleaning the heat transfer surfaces are associated with each heat transfer surface system, each of the latter being respectively associated with a cylindrical container part.

1 Claim, 2 Drawing Figures

SUBSTANTIALLY VERTICAL APPARATUS FOR COOLING PROCESS GASES ORIGINATING FROM A GASIFICATION PROCESS

The present invention relates to a substantially vertical apparatus for cooling process gases originating from a gasification process, along with simultaneous separation of solid matter contained in the process gases.

With process gases which are generated in a gasification reactor, for example those in gasification or destructive distillation of coal, it is necessary to cool off gasification gases, which exit the reactor at a temperature of approximately 1500° C., to a temperature which renders possible an undisturbed subsequent treatment in a technical process.

Additionally, aside from the cooling-off, it is also worth obtaining an intensive mixing effect of the gasification gases laden with solid and liquid matter along the conveying route thereof in order, in a so-called final cooling which as a rule is operated convectively, to have a gas which is extensively reactively neutral with respect to the heat surfaces installed there.

It is also worthwhile to separate off at least a portion of the solid matter contained in the process gases prior to a cooling-off in the convective heat transfer surfaces.

It is therefore an object of the present invention to develop an apparatus of the aforementioned general type with which the process gases, which come from a gasification reactor, can be cooled off and extensively made free of solid matter.

Figure 1:
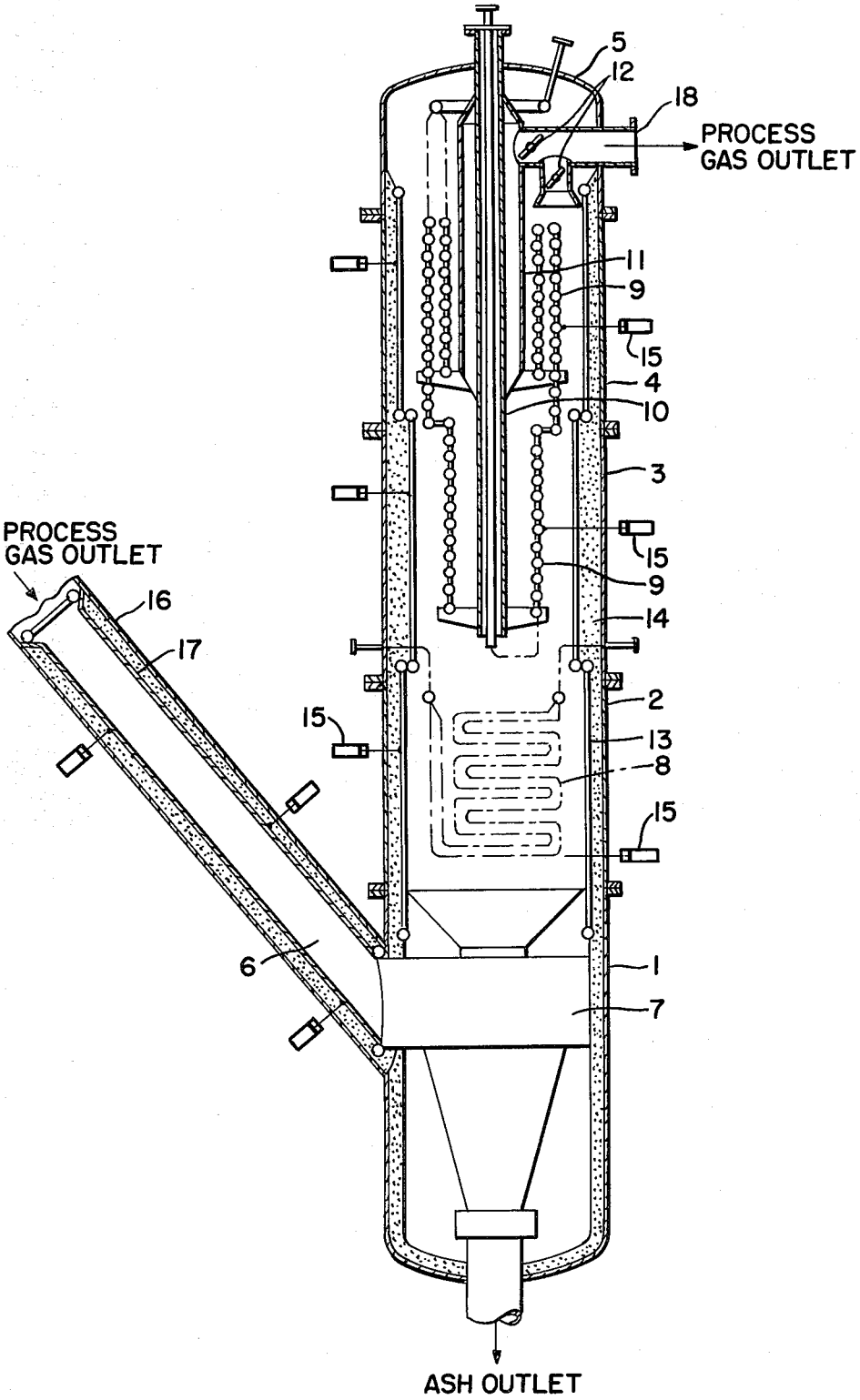
Figure 2:
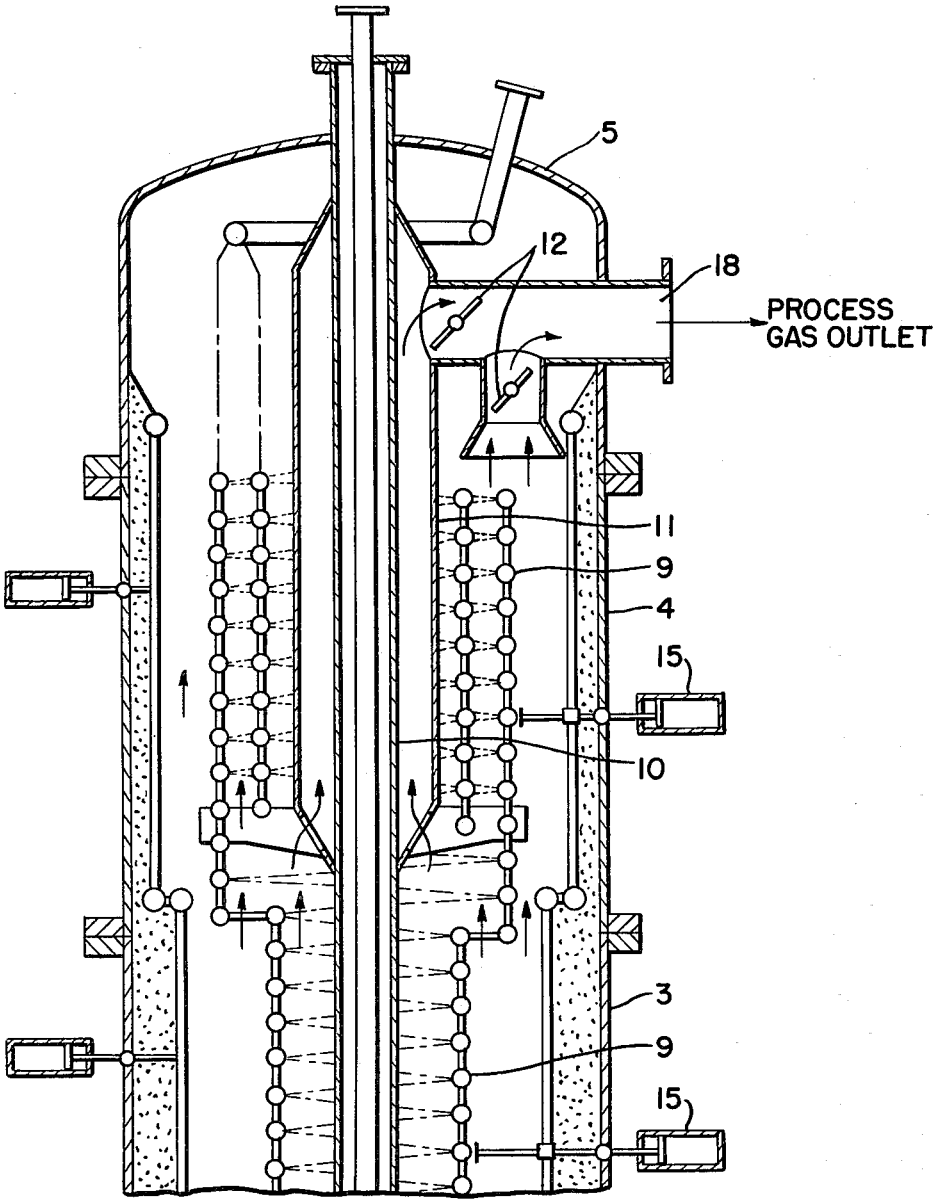

This object, and other obJects and advantages of the present invention, will appear more clearly from the following specificataion in connection with the accompanying drawings, in which:

FIG. 1 shows a vertical section through the apparatus in accordance with the present invention; and FIG. 2 likewise shows a vertical section in an enlarged illustration of the upper portion of the apparatus of FIG. 1.

The apparatus of the present invention is characterized primarily in that the apparatus has a cylindrical container which comprises several cylindrical container parts; in that a gas inlet is provided in the lower region of the container mantle and substantially tangential thereto, which gas inlet opens into a cyclone; in that cooling surfaces are provided above the cyclone, with those directly above the cyclone being embodied as platen, heat transfer surfaces, and those further up being embodied as cylindrical heat transfer surfaces; in that the cylindrical heat transfer surfaces are suspended in the container via support elements in the manner of an immersion heater, with the support elements, in conjunction with a tube and a regulating device arranged at the process gas outlet, regulating the quantity or volume of the process gases flowing or circulating around the upper cylindrical heat transfer surface; in that, aside from the platen heat transfer surfaces and the cylindrical heat transfer surfaces, container wall cooling surfaces are provided as vertical heat transfer surfaces having a tube-crosspiece-tube construction, the container wall cooling surfaces being centered with respect to the outer wall of the container via a packing mass; and in that beating or striking devices for cleaning the heat transfer surfaces are associated with each heat transfer surface system, each of the latter being respectively associated with a cylindrical container part.

Referring now to the drawings in detail, as can be seen from FIGS. 1 and 2, the process gases coming from a non-illustrated reactor pass via the line or conduit 16, which internally contains cooling surfaces 17 in the form of tubes having a tube-crosspiece-tube construction, into a cylindrical container, which comprises several cylindrical container parts 1, 2, 3, 4 and 5. The gas inlet 6 is located in the lower region of the container shell or mantle, and is arranged tangentially thereto. The gas inlet 6 opens into a cyclone 7 in which a portion of the solid matter is separated from e process gas. Cooling surfaces are provided above the cyclone 7. Those cooling surfaces which are arranged directly above the cyclone 7 are embodied as platen heat transfer surfaces 8. The heat transfer surfaces located farther up are embodied as cylindrical heat transfer surfaces 9. The cylindrical heat transfer surfaces 9 are suspended in the container via support elements 10 in the manner of an immersion heater. The arrangement of the support elements 10 is such that between the middle cylindrical heat transfer surfaces and the upper cylindrical heat transfer surfaces, in conjunction with a tube 11 and a regulating device 12 arranged at the process gas outlet 18, the volume of process gases circulating around the upper cylindrical heat transfer surfaces can be regulated, so that on the outlet side the requirement is always met for an extensively constant gas outlet temperature. In addition to the platen heat transfer surfaces 8 and the cylindrical heat transfer surfaces 9, container wall cooling surfaces 13 are also provided as vertical heat transfer surfaces in a tube-crosspiece-tube construction. These container wall cooling surfaces 13 are centered relative to the container outer all via a packing mass 14. Beating or striking devices 15 are associated with each heat transfer surface system 8, 9, and 13 for cleaning the latter.

The advantages that are attained with the present invention include the following:

the process gases are cooled prior to entry into the hot gas cyclone;

the cooling surface can be cleaned with the aid of beating or striking devices during operation;

the pressure shell or mantle is protected by the cooling surface;

the hollow spaces between the cooling surface and the pressure shell or mantle can be filled with an insulating mass;

the cyclone is integrated in the pressure container;

the wall heat transfer surfaces in the container parts can be cleaned with the aid of beating or striking devices during operation;

the platen and cyclone heat transfer surfaces can be cleaned by beating or striking devices during operation;

the platen and cyclone heat transfer surfaces are suspended in the container in the manner of an immersion heater;

the intermediate spaces between the wall heat transfer surface and the pressure-bearing container wall can be filled with insulating mass to avoid hollow spaces; and the process gas outlet temperature can be kept constant by a bypass tube.

The present invention is, of course, in no way restricted to the specific disclosure of the specification and drawings, but also encompasses any modifications within the scope of the appended claim.

What we claim is:

1. A substantially vertical apparatus for cooling process gases originating from a gasification process, and for simultaneously separating off solid matter contained in said process gases, said apparatus comprising:

a cylindrical container having a container mantle and including several cylindrical container parts;

a cyclone in the lower cylindrical container part;

a gas inlet conduit arranged substantially tangential to said container mantle and in communication with said cyclone;

means for cooling the process gases prior to entry into said cyclone;

an outlet, for solid material, located below said cyclone;

cooling surfaces arranged above said cyclone, including platen heat transfer surfaces directly above said cyclone, and cylindrical heat transfer surfaces above said platen heat transfer surfaces, each of said heat transfer surfaces being located within a different cylindrical container part;

support elements in said container and on which said cylindrical heat transfer surfaces are suspended in the manner of an immersion heater;

a tube surrounding said support elements;

an outlet for process gas, connected to said tube;

a regulating device in said gas outlet, said support elements, in conjunction with said tube and said regulating device, being adapted to regulate the volume of process gas flowing around the upper portion of said cylindrical heat transfer surfaces;

container-wall cooling surfaces on the inner wall of said container mantle in the form of vertical heat transfer surfaces having a tube-crosspiece-tube construction;

a packing mass located between the outer wall of said container mantle and said container-wall cooling surfaces for centering the latter relative to said outer wall; and cleaning elements associated with said container for cleaning said heat transfer surfaces.

* * * * *